United States Patent [19]

Löthman

[11] 4,331,288

[45] May 25, 1982

[54] PACKING CONTAINER

[75] Inventor: Stig A. Löthman, Veberöd, Sweden

[73] Assignee: Tetra Pak International AB, Lund, Sweden

[21] Appl. No.: 176,976

[22] Filed: Aug. 11, 1980

[30] Foreign Application Priority Data

Aug. 22, 1979 [SE] Sweden ..... 7907000

[51] Int. Cl.[3] ..... B65D 5/72

[52] U.S. Cl. ..... 229/17 R

[58] Field of Search ..... 229/17 R, 62, 87 F, 229/DIG. 11

[56] References Cited

U.S. PATENT DOCUMENTS 3,347,444 10/1967 Rausing et al. ..... 229/17 R

FOREIGN PATENT DOCUMENTS 11348 5/1980 European Pat. Off. ..... 229/17 R

*Primary Examiner*—Herbert F. Ross

*Attorney, Agent, or Firm*—Burns, Doane, Swecker & Mathis

[57] ABSTRACT

The present invention relates to a packing container particularly for liquid substances. The packing container includes a sealing fin along which material layers forming the packing container are adjoined to one another. The sealing fin extends both over a wall of the packing container and over a corner lug adjoining the wall which corner lug is adapted to be folded against the wall. A portion of the sealing fin extending over the packing container wall is folded down against the wall in one direction and a portion of the sealing fin extending over the corner lug is folded down in an opposite direction.

4 Claims, 2 Drawing Figures

PACKING CONTAINER

BACKGROUND AND SUMMARY OF THE PRESENT INVENTION

The present invention relates to a packing container of the type which has a sealing fin.

A known and frequently encountered packing container for the packing e.g. of milk is manufactured from a flexible, weblike laminate which comprises a central carrier layer of paper coated on both sides with thin layers of liquid-tight, heat-sealable plastic material, e.g. polyethylene. The laminate is supplied to a packing machine in the form of a roll and is converted on being rolled off the roll successively to tubular form and at the same time has its longitudinal edges are sealed to one another in liquid-tight manner. The tube is fed substantially vertically downwards through the packing machine. The tube is supplied continuously with contents via a pipe which extends into the tube at the upper end of the same. By means of level-controlling elements it is ensured that the surface of the contents is constantly maintained at a certain level. Below this level subsequently a repeated transverse sealing of the tube takes place. The tube is compressed at equal intervals with the help of heated sealing jaws, as a result of which the heat-sealable plastic layers present on the inside of the tube join the tube sides together in liquid-tight, transverse sealing zones. Thus a series of coherent, substantially cushion-shaped packing containers is produced, which are separated from one another by cutting through the sealing zones. Further shaping of the filled cushion-shaped containers gives these a final, substantially parallelepipedic form. In this final shaping process four double-walled corner lugs appear which are formed of material which for geometrical reasons can not be utilized in the formation of the actual parallelepipedic container body. So as not to be in the way or interfere with the regular parallelepipedic shape these flattened corner lugs are folded against and are sealed to adjoining packing container surfaces. The packing container is now finished.

As is evident from the above, cushion-shaped packing containers result from the transverse sealing and cutting off of the filled material tube. The packing containers at their upper and lower end are provided with sealing fins. After conversion of the cushion-shaped container to parallelepipedic shape, these sealing fins will extend substantially centrally over the upper and lower end wall of the packing container as well as over the corner lugs adjoining these end walls. The sealing fin thus extends transversely over the end wall of the packing container between the two free corners of the corner lugs adjoining the end wall. In connection with the shaping of the parallelepipedic packing container the sealing fins are folded down so that they rest against the material surface to which they are connected. As mentioned earlier, the flattened corner lugs are folded in and attached to adjoining container walls. The two corner lugs present at the bottom end of the packing container are usually folded against the bottom of the packing container. This folding is rendered difficult, however, by the sealing fin running over the bottom end as well as over the two corner lugs. When a corner lug is folded in to rest against the bottom of the packing container it is thus necessary to fold over 180° not only the two material layers which form the corner lug itself but also the sealing fin formed of two material layers. Consequently, after folding in and attachment to the bottom of the packing container the corner lug will not be wholly plane but will somewhat bulge outwards. This is of course a disadvantage, since the packing container will consequently stand up less well when put in upright position on a plane surface.

The folding over 180° of the corner lug and the sealing fin extending over the corner lug is difficult to perform, owing to the manifold material thickness, in such a manner that the folding line becomes well defined and sharp. Earlier attempts to improve and simplify the folding with the help of folding lines and crease lines have been largely unsuccessful, since in spite of these expedients the folding gives rise to a compressed accumulation of material in the line of intersection between the sealing fin and the folding line. Consequently the material layers which after folding are located on the "outside" of the folding (that is to say the material situated outside the eventual neutral plane) will be subjected to very strong tensile stresses with attendant stretching and crack formations. These tensile stresses are so great that the layers of thermoplastics included in the laminate frequently crack and leakages occur as a consequence. When the laminate also contains layers of aluminium foil, which is frequently the case, crack formation is almost unadvoidable, since the aluminium foil has appreciably inferior stretching properties compared to the properties of the thermoplastic material.

To avoid the abovementioned disadvantages it has been endeavoured up to now, among other things, to increase to the greatest possible extent the elasticity of the materials included. This solution gives relatively good results insofar as the thermoplastic layers are concerned, but does not solve the problem of any aluminium layers included in the laminate.

It is an object of the present invention to provide a packing container which, while being of substantially the same design as earlier packing containers, avoids the aforementioned problems and makes it possible to fold the corner lugs in against the bottom surface of the packing container without the sealing fin which extends over the lug causing problems of the aforementioned kind.

It is a further object of the present invention to provide a packing container which is simple to manufacture and which only requires a slight modification of present manufacturing machines.

It is a further object of the present invention to provide a packing container where the folding in of the corner lugs against the wall surfaces of the packing container is facilitated and where the corner lugs after folding in retain a generally plane shape.

Finally it is an object of the present invention to provide a packing container where the folding in of the corner lugs and the sealing fin extending over the corner lugs can be carried out without any risk whatever of crack formation occuring in the material layers of the packing laminate.

These and other objects have been achieved in accordance with the present invention in that a packing container of the type described in the introduction has been given the characteristic that a portion of the sealing fin extending over the packing container wall is folded down against the wall in one direction, while a portion of the sealing fin extending over the corner lug is folded down against the corner lug in the opposite direction.

Preferred embodiments of the packing container in accordance with the invention have moreover been given the characteristics evident from the subsidiary claims.

BRIEF DESCRIPTION OF THE DRAWINGS

A preferred embodiment of the packing container in accordance with the invention will now be described in detail with special reference to the enclosed schematic drawings wherein like members bear like reference numerals and wherein.

DETAILED DESCRIPTION OF THE PREFERRED EMBODIMENT

The invention will be described as applied to a packing container of substantially parallelepipedic shape, e.g. a packing container of the type which is described in Swedish Pat. No. 406,177, but the invention is of course applicable to any type of packing container whatever which incorporates the features mentioned in the introduction.

The known packing container (FIG. 1), similarly to the packing container in accordance with the invention (FIG. 2), is of the parallelepipedic type and comprises four substantially rectangular side walls 1 (only one of which is visible in the figures) and two likewise substantially rectangular end walls 2 (only one of which, namely the bottom wall, is visible in the figures). The packing container is manufactured from a flexible, relatively rigid, web-shaped laminate which has been formed to a tube which by flattening and transverse sealing has been closed off in narrow transverse zones. After likewise transverse cutting through the said zones, cushion-shaped packing containers are produced which at their upper and lower ends are provided with sealing fins 3. The sealing fins 3 after conversion of the packing containers to parallelepipedic shape, extend transversely over the two end walls 2 of the packing container. On the known packing container (FIG. 1) the sealing fins 3 have been folded down over their whole length to rest against the underlying material surface to which they are connected.

Figure 1:
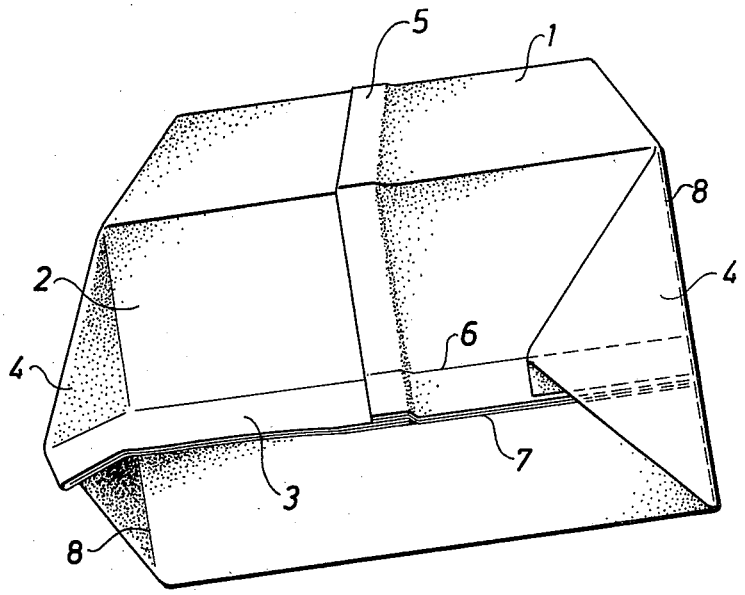
Fig. 1 PRIOR ART
FIG. 1 is a perspective view of a packing container of known type from underneath.

In the shaping process which is required for the conversion of the cushion-shaped packing container to the parallelepipedic shape shown, four substantially triangular, double-walled corner lugs 4 are formed (of which only the two lugs situated at the bottom of the packing container are shown in the figures). The corner lugs 4 are folded over about the straight wall edges 8 along which they are connected to the actual parallelepipedic packing container. The corner lugs 4 are fixed by means of heat-sealng to the end wall 2 of the packing container. In FIG. 1 as well as in FIG. 2, for the sake of clarity, only the one corner lug is shown in its final, folded-down position. The corner lug situated at the opposite end of the end wall 2 is shown in partly folded-up position. It can be clearly seen how the sealing fin 3 running over the end wall 2 extends over one side of the corner lug 4 to terminate at the free end of the corner lug remote from the end wall 2.

Figure 2:
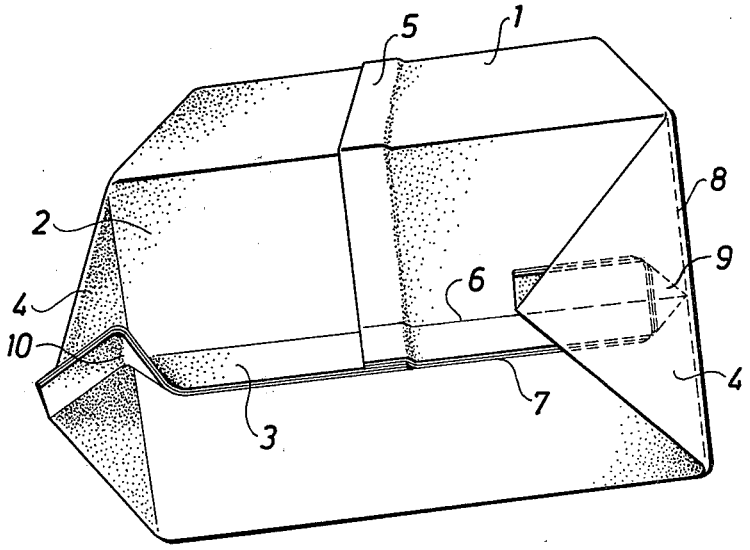
FIG. 2 is a perspective view of a packing container in accordance with the invention from underneath.

In FIG. 1 as well as in FIG. 2, a longitudinal joint 5 is formed during the sealing of the lonigitudinal edges of the material web after the conversion of the material web to tubular form. The longitudinal joint 5 extends over one side wall 1 of the packing container and over parts of adjoining end wall 2, where the longitudinal joint 5 crosses a baseline 6 which divides the sealing fin 3 from the end wall 2 and terminates at the free edge line 7 of the sealing fin 3.

The sealing fin 3 extending over the bottom wall 2 of the packing container consists, as mentioned earlier, of parts of the material layers forming the packing container, which have been placed together and sealed to each other inside against inside. The sealing fin 3 so produced, in order not to be an obstacle, must be folded in against the underlying material layer, as shown in FIG. 1. In the subsequent folding in of the corner lugs 4 not only the material layers forming the corner lugs will be folded, but also the part of the sealing fin 3 running over the corner lug. The sealing fin, owing to its thickness, is difficult to fold and consequently makes much more difficult the folding in of the corner lugs 4 to rest against the bottom end wall 2 of the packing container. When the corner lug is folded in, the sealing fin 3 will be pressed together and, formimg a fold, will be pressed inwards towards the bottom wall of the packing container. The bottom end wall 2 in the area situated underneath the folded in corner lugs 4 will consequently bulge inwards into the packing container. The double sealing fin 3 situated underneath the corner lugs 4 thus has the effect that the portion of the packing material, which is folded about 180° along an edge line 8 dividing the corner lug 4 from the bottom wall 2, will have a thickness along part of the said edge line which is three times as great as the normal thickness of the material. This renders more difficult of course, as already mentioned, the folding itself, but it also subjects the material layers in the transition area between this thickened portion and the adjacent portion of normal thickness, that is to say in the point of intersection between the base line 6 and the edge 8, to strong stresses. These stresses arise in particular in the material layers which in the folding come to lie outside the neutral folding plane. These material layers are then subjected to a tensile stress which often not only deforms the material, but also stretches the material layers beyond their rupture limit so that cracks are produced. As mentioned previously, this cracking is particularly critical if the packing laminate comprises a layer of aluminium foil, but the liquid-tight thermoplastic layers are also effected. If cracking occurs the packing container commences to leak.

The packing container in accordance with the present invention (FIG. 2) is formed in such a manner that the material accumulation described above and the consequent crack formation and leakage problem are avoided. This has been achieved by providing a packing container of otherwise conventional design with a new bottom design, calculated in particular to distribute the different material layers as evenly as possible when the sealing fin 3 is folded down and the corner lugs 4 are folded in. As can be seen from the drawing, the sealing fin 3 (up to now the reference designations are identical in FIGS. 1 and 2) on the packing container in accordance with the invention (FIG. 2) has been folded in a different manner. A portion of the fin 3 extending over the packing container wall, that is to say the central portion of the fin, is folded down against the packing container wall in one direction, while the portions of the sealing fin extending over the corner lugs are folded down against the respective corner lug in the opposite direction. This folding of different portions of the sealing fin 3 in opposite directions has the result, after a corner lug 4 has been folded down to lie against the bottom wall 2, that the part of the sealing fin 3 extending over the corner lug 4 is placed alongside the part of the sealing fin 3 running over the bottom wall 2 and not, as previously, on top of the same. This is clearly recognizable in FIG. 2 where the part of the sealing fin 3 situated underneath the folded-down corner lug 4 to the right in the figure is indicated by means of broken lines. The folding down of different parts of the sealing fin 3 in opposite directions also means that the thickening of material caused by the sealing fin no longer crosses the edge line 8, but merely projects with an arrowlike point and touches the edge line 8. This arrangement appreciably facilitates the folding down of the corner lug along the edge line 8. While it is true that a limited triangular area (indicated by reference designation 9 in FIG. 2) will still be produced, this area is situated inside the edge line 8 and therefore does not make the folding difficult.

The folding down of the different parts of the sealing fin 3 in opposite directions can only be carried out simultaneously with the folding in of the corner lugs 4. Otherwise the area of the sealing fin 3 situated adjoining the edge line 7 is subjected to impermissible stress in the transition area between the parts of the fin folded down in different directions situated at the crossing with the edge line 8. By carrying out the folding down of different parts of the sealing fin simultaneously with the folding in of the corner lugs 4, on the other hand, the folding becomes possible without either the sealing fin or other parts of the packing container being subjected to impermissible forces. With reference to the left in FIG. 2, the corner lug 4 is in a position during the folding in from its original placing as an extension of the bottom wall 2 to the final position resting against the bottom wall 2.

In order to facilitate the folding of the sealing fin 3 in different directions and in particular the folding in of the transition area at the intersection with the edge line 8, the sealing fin 3 is appropriately provided with weakening lines which are placed in the transition area 10 between the two portions folded down in opposite directions. The weakening lines extend between the free edge line 7 of the fin and the base line 6 of the fin. The weakening lines appropriately consist of crease lines which relative to the base line extend substantially at an angle of 45° in both directions from the point of intersection of the base line with the edge line 8 which divides the lug from the packing container wall. By this weakening line arrangement the folding is guided so that after the corner lug 4 has been folded in to lie against the bottom wall 2, the sealing fin will obtain the desired arrow-shape which is evident in the righthand part of FIG. 2.

In order further to facilitate the folding down of the sealing fin 3, and more particularly its central part, it has been found appropriate, moreover, in the type of packing container which is provided with a fin with crossing longitudinal joint 5, to fold down the portion of the sealing fin 3 extending over the packing container wall in the direction away from this longitudinal joint 5, since the sealing fin 3, owing to the material thickening caused by the longitudinal joint 5, has a natural tendency towards being folded in this direction.

The production of packing containers in accordance with the invention eliminates the difficulties in the folding down of a corner lug provided with sealing fin, and in this way contributes not only to packages with greater tightness, but also makes it possible in certain cases to reduce the thickness of the layers of aluminium foil and plastic material included in the packing material which means an appreciable saving in cost. It should be noted that the change in design making this possible is relatively small, so that the packing container can be manufactured on conventional packing machines of known type, provided these are modified to permit the special double-directed folding down of the different parts of the sealing fin 3. This is of course a considerable advantage, since it makes possible the modification at low cost of already existing packing machines.

The principles and preferred embodiment of the present invention have been described in the foregoing specification. However, the invention which is intended to be protected is not to be construed as limited to the particular embodiment disclosed. The embodiment is to be regarded as illustrative rather than restrictive. Variations and changes may be made by others without departing from the spirit of the present invention. Accordingly, it is expressly intended that all such variations and changes which fall within the spirit and scope of the present invention as defined in the appended claims be embraced thereby.

What is claimed is:

1. A packing container, comprising a sealing fin along which material layers forming the packing container are joined to one another, said sealing fin extending both over a wall of the packing container and over a corner lug adjoining said wall, said corner lug being adapted to be folded back against said wall, a portion of the sealing fin extending over the packing container wall being folded down against the wall in one direction and, a portion of the sealing fin extending over the corner lug being folded down in the opposite direction.

2. The packing container in accordance with claim 1, wherein the sealing fin in the transition area between the two portions folded down in opposite directions is provided with weakening lines which extend between a free edge of the fin and a base line of the fin.

3. The packing container in accordance with claim 2, wherein the weakening lines comprise crease lines which extend at an angle of substantially 45° in both directions from the point of intersection of the base line with an edge line which divides the corner lug from the packing container wall.

4. The packing container in accordance with any one of the preceding claims, wherein the packing container is provided with a longitudinal joint crossing the fin, the portion of the sealing fin extending over the packing container wall being folded down in the direction away from said longitudinal joint.

* * * * *